US008453868B2

(12) United States Patent
Cola

(10) Patent No.: US 8,453,868 B2
(45) Date of Patent: Jun. 4, 2013

(54) GAS CYLINDER

(75) Inventor: Gian Luigi Cola, Venice (IT)

(73) Assignee: Faber Industrie S.p.A., Udine (IT)

( * ) Notice: Subject to any disclaimer, the term of this patent is extended or adjusted under 35 U.S.C. 154(b) by 0 days.

(21) Appl. No.: 13/320,232

(22) PCT Filed: Aug. 9, 2010

(86) PCT No.: PCT/IT2010/000364
§ 371 (c)(1),
(2), (4) Date: Mar. 12, 2012

(87) PCT Pub. No.: WO2012/020435
PCT Pub. Date: Feb. 16, 2012

(65) Prior Publication Data
US 2012/0241461 A1 Sep. 27, 2012

(51) Int. Cl.
*F17C 1/02* (2006.01)

(52) U.S. Cl.
USPC ..... 220/586

(58) Field of Classification Search
USPC ..... 220/4.12, 23.91, 495.01, 582, 586, 220/588, 589, 723; 215/3; 137/563
See application file for complete search history.

(56) References Cited

U.S. PATENT DOCUMENTS

| | | | | |
|---|---|---|---|---|
| 3,446,385 | A | 5/1969 | Ponemon | |
| 7,021,488 | B2 * | 4/2006 | Thompson | 220/586 |
| 7,389,890 | B1 | 6/2008 | Hampsten | |
| 8,141,845 | B2 * | 3/2012 | Adams et al. | 251/144 |
| 2004/0056164 | A1 | 3/2004 | Eihusen et al. | |
| 2005/0023236 | A1 * | 2/2005 | Adams et al. | 215/3 |
| 2007/0077470 | A1 | 4/2007 | Adams et al. | |

FOREIGN PATENT DOCUMENTS

DE 21 2009 000 005 U1 3/2010

* cited by examiner

*Primary Examiner* — Harry Grosso
(74) *Attorney, Agent, or Firm* — Dickstein Shapiro LLP

(57) ABSTRACT

A gas cylinder (1) internally defining a gas storage space (2) able to be closed by a stop valve (3) comprises a rigid wall (4) made from composite material having a reinforcing layer (5) containing reinforcing fibres and an inner surface (6) and a flexible sealing wall (13) connected to the rigid wall (4) through a mouth (9) and suitable for adhering in pressing contact against the inner surface (6) of the rigid wall (4).

18 Claims, 4 Drawing Sheets

GAS CYLINDER

The object of the present invention is a gas cylinder made from synthetic or composite material for storing gas under pressure.

Known gas cylinders made from composite material usually comprise an inner layer, for example made from steel or synthetic material, which ensures the impermeability to the stored gas, and an outer layer made from composite material reinforced with fibres that ensures the mechanical resistance of the cylinder to the operating pressures, as well as a mouth that forms a through opening from the inside to the outside of the cylinder and a seat for receiving a valve for opening and closing the through opening.

The gases in the cylinders are classified as compressed gases if their critical temperature is below −50° C. like hydrogen or oxygen, as liquefied gases if the critical temperature is above −50° C. like LPG and as dissolved gases as for example acetylene in acetone.

The cylinders are intended for many uses and the standards for making them and testing them vary according to the application. Amongst the main applications of gas cylinders, we can quote the storage of liquefied or compressed gases for vehicular transport, domestic or industrial uses, the storage of compressed or liquefied gases for industrial use, holding tanks for compressed air, the storage of breathable mixtures for respirators, the storage of medical gases and fire extinguishers.

Thanks to the use of different materials for the functions of impermeabilising and mechanical resistance to pressure, composite gas cylinders have a very low weight/containment capacity ratio compared to steel gas cylinders.

However, the relatively complex structure of composite gas cylinders and the interaction between the different material of the impermeabilising layer, of the reinforcing layer and of the mouth involve problems of sealing the cylinder and phenomena of deterioration of the synthetic materials and of the interface areas between the inner layer, the outer layer and the mouth, in particular in case of extended operating times.

Such structural and seal deterioration is worsened by the difference of the thermal expansion coefficients of the materials of the inner impermeabilisation layer and of the outer reinforcing layer (which are connected together over the entire surface), which involves a cyclical stressing of the two layers and by their interfacing due to the prevention of their free and independent thermal deformation.

The purpose of the present invention is therefore to provide a composite gas cylinder, having features such as to improve the impermeability in case of long operating periods and to avoid phenomena of structural deterioration with reference to the prior art.

This and other purposes are achieved through a gas cylinder internally defining a gas storage space able to be closed by a stop valve, wherein said cylinder comprises:

- a rigid wall made from composite material having a reinforcing layer containing reinforcing fibres and an inner surface that defines an inner space accessible through an access opening formed in the rigid wall,
- a tubular mouth able to be removably connected to the access opening of the rigid wall and configured to receive the stop valve in communication with the gas storage space,
- a flexible sealing wall arranged in the inner space and connected to the rigid wall only through the mouth, said flexible sealing wall internally defining the gas storage space and being suitable for adhering in pressing contact against the inner surface of the rigid wall, wherein the rigid wall is permeable to air so as to allow a complete expansion of the flexible wall in the inner space and the inner surface is formed from a sliding layer of the rigid wall that is different from the reinforcing layer and that allows sliding in pressing contact between the flexible sealing wall and the rigid wall.

Thanks to the freedom of movement in pressing contact between the flexible sealing wall and the rigid wall and to their connection in a single area at the access opening of the rigid wall it is possible to avoid the phenomena of deterioration of the interfaces between the different layers and materials of the cylinder and the mouth, maintaining an excellent seal also in case of very long operating times.

Moreover, thanks to the removable connection of the mouth to the access opening of the rigid wall it is possible to replace the flexible sealing wall and gain access to the inner space of the rigid wall in order to inspect and regenerate the sliding layer.

In order to better understand the present invention and to appreciate its advantages, some non-limiting example embodiments will be described hereafter, with reference to the figures, in which.

Figure 1:
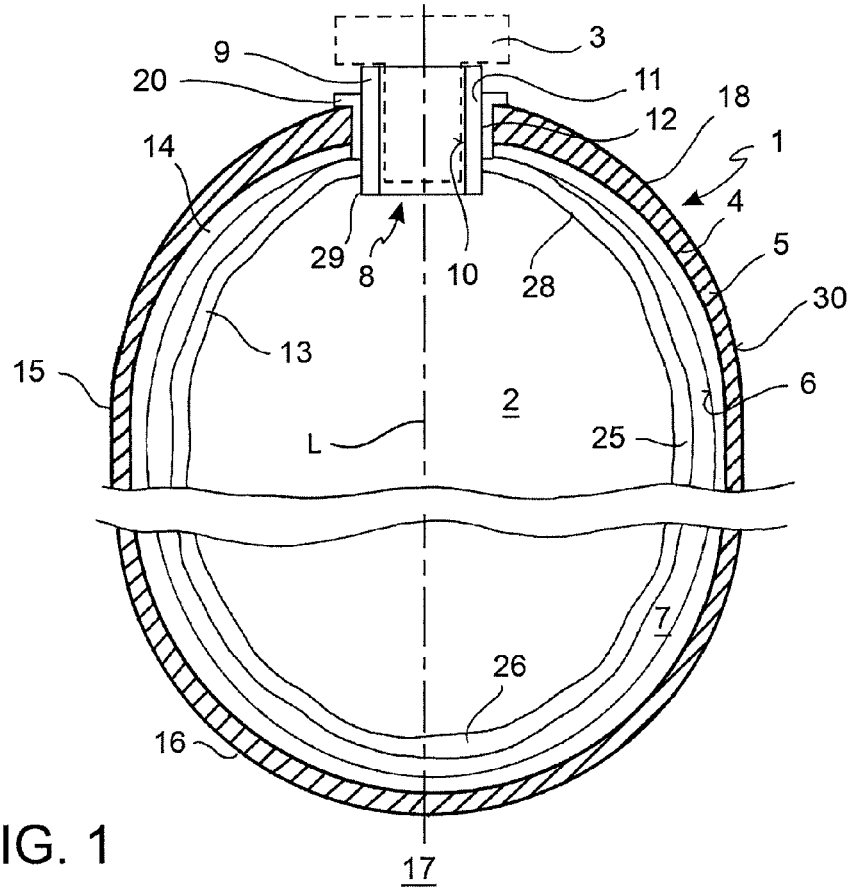
FIG. 1 is a longitudinal section view of a gas cylinder according to one embodiment of the invention.

With reference to the figures, a gas cylinder (hereafter "cylinder") is wholly indicated with reference numeral 1.

Cylinder 1 internally defines a gas storage space 2 able to be closed by a stop valve 3 and comprises a rigid outer wall 4 made from composite material that has a reinforcing layer 5 containing reinforcing fibres and an inner surface 6 that defines an inner space 7 accessible through an access opening 8. Such an access opening 8 preferably constitutes the only opening of the rigid outer wall 4 suitable for receiving a mouth for a valve and/or directly the valve.

In the present description of the invention, the term "composite material" denotes a material with a non-homogeneous structure, consisting of the assembly of two or more different substances, physically separated by a clear interface of zero thickness and equipped with substantially different physical and chemical properties that remain separate and distinct at macroscopic and structural level. In particular, the composite material may comprise fibres of natural or artificial materials, for example glass fibres, carbon fibres, ceramic fibres, aramid fibres, such as Kevlar®, embedded in a matrix made from a preferably but not necessarily synthetic material, for example thermoplastic like Nylon® and ABS or thermosetting like epoxy resins or polyester resin or metals, such as for example aluminium, titanium and alloys thereof or a ceramic material, generally silicon carbide or alumina.

According to one embodiment, the rigid wall 4 comprises a tubular portion 15, preferably substantially cylindrical and extending along a longitudinal axis L of the cylinder 1, a bottom portion 16, for example spherical or elliptical cap-shaped, which connects to a lower end of the tubular portion 15 and defines the inner space 7 on a lower side 17 of the cylinder 1, as well as an upper portion 18, for example shaped like an ogive, which connects to an upper end of the tubular portion 15 and defines the inner space 7 on an upper side 19 of the cylinder 1 opposite to the lower side 17.

Cylinder 1 further comprises a tubular mouth 9 able to be removably connected to the access opening 8 of the rigid wall 4 and configured to receive the stop valve 3 in communication with the gas storage space 2.

According to one embodiment, the mouth 9 may be made from synthetic or metallic material and may comprise a valve seat 10, for example a frusto-conical or cylindrical internal threading with a seat for a gasket, for the connection of the valve 10 in the mouth 9, as well as a cylinder connection portion 11, for example an external threading or a bayonet portion suitable for engaging a corresponding mouth connection seat 12 formed from the rigid wall 4 at the opening 8.

According to one embodiment, the connection seat 12 comprises a threading formed from the reinforcing layer 5 or a body 20 eventually threaded with many distinct pieces or in a monoblock removably connected (for example through screw clamping) with one edge of the opening 8 formed by the reinforcing layer 5 after its completion and setting. This facilitates and speeds up the winding process of the reinforcing layer and the entire assembly of the gas cylinder.

Alternatively, such a body 20 may be connected to the rigid wall through at least partial over-winding of the reinforcing layer.

The connection between the mouth 9 and the rigid wall 4 is configured to withstand the forces resulting from the pressure of the gas in the area of the opening 8, but it is not necessarily impermeable to gases and it could even be configured so as to create an area of programmed permeability of the rigid wall 4.

A flexible sealing wall 13, shaped like an inflatable bag impermeable to gases that are intended to be stored, is arranged in the inner space 7 and connected to the rigid wall 4 only through the mouth 9 and only at the mouth 9. The flexible sealing wall 13 internally defines the gas storage space 2 and is suitable for adhering in pressing contact against the inner surface 6 of the rigid wall 4.

According to one embodiment, in an undeformed state the flexible sealing wall 13 has a shape defined by a tubular portion 25, preferably substantially cylindrical and extending along a longitudinal axis L of the cylinder 1, a bottom portion 26, for example shaped like a spherical or elliptical cap, which connects to a lower end of the tubular portion 25 and defines the gas storage space 2 on the lower side 17 of the cylinder 1, as well as an upper portion 28, for example nose cone-shaped, which connected to an upper end of the tubular portion 25 and defines the gas storage space 2 on the upper side 19 of the cylinder 1 opposite the lower side 17.

According to one aspect of the invention, the rigid wall 4 is permeable to air so as to allow a complete expansion of the flexible sealing wall 13 in the inner space 7 and the inner surface 6 is formed by a sliding layer 14 of the rigid wall different from the reinforcing layer and that allows sliding in pressing contact between the flexible sealing wall 13 and the rigid wall 4. In one embodiment, the sliding layer 14 has no fibres. According to an alternative embodiment, the sliding layer 14 comprises a fabric that will be described later on.

Thanks to the freedom of movement in sliding contact between the flexible sealing wall and the rigid wall and their connection in a single area at the access opening of the rigid wall it is possible to avoid the phenomena of deterioration of the interfaces between the different layers and materials of the cylinder and the mouth, maintaining an excellent seal also in case of very long operating times.

Moreover, thanks to the removable connection of the mouth to the access opening of the rigid wall it is possible to replace the flexible sealing wall and gain access to the inner space of the rigid wall in order to inspect and regenerate the sliding layer.

The rigid outer wall 4 performs the function of withstanding the internal pressure exerted by the stored gas and it may be manufactured through winding filaments of continuous carbon fibres impregnated with epoxy resin on a mandrel. The mandrel itself may then be removed, for example through dissolving, mechanical crumbling or disassembly in the case of a mandrel in many pieces.

Alternatively, the mandrel around which the reinforcing layer 5 is wound stays integrated in the rigid wall 4 and forms a layer thereof, for example the aforementioned sliding layer 14 or an intermediate layer (not illustrated) between the reinforcing layer 5 and the sliding layer 13.

The reinforcing fibres of the reinforcing layer 5 have a tensile strength of over 4500 MPa, preferably from 4800 MPa to 5200 MPa and a modulus of elasticity of over 200 GPa, preferably from 200 to 250 GPa.

Advantageously, the reinforcing layer 5 comprises a content (volumetric) of reinforcing fibres within the range from 50% vol to 70% vol, preferably from 55% vol to 65% vol, even more preferably of about 60% vol, in which the rest of the volume is formed by the matrix that may be an epoxy or vinyl ester resin made to set through a heat treatment, for example heating to about 120° lasting about 5 hours.

The sliding layer 14 advantageously has a smooth exposed surface without edges or steps (with the exception of the edge of the preferably single access opening 8) and it may comprise a synthetic material, preferably thermoplastic, for example selected from the group comprising polyethylene, polyester, PET (polyethylene terephthalate), polyvinylchloride, polytetrafluoroethylene. In accordance with an embodiment, the sliding layer 14 comprises a fabric of fibres or natural or synthetic filaments, for example made from polyester, which may be further coated or directly exposed in the inner space 7.

Alternatively or additionally, the sliding layer 14 may comprise a fluid, for example lubricant gel or grease, or a lubricant powder containing for example nano-particles suitable for reducing the friction coefficient between the rigid wall 4 and the flexible sealing wall 13.

The sliding layer 14 may be fixed to the rigid wall 4 through:

- blow-moulding in a mould consisting of the reinforcing layer 5 with one or more optional intermediate layers and/or
- moulding of the sliding layer 14 (for example through a different mould from the reinforcing layer) and subsequent winding of the reinforcing layer 5 around the sliding layer 14 and/or
- spraying and/or
- dip coating that in the present case provides for the temporary filling of the inner space 7 with a coating liquid or with a coating powder that deposits the sliding layer 14 on the semi-worked product of the rigid wall 4.

The flexible sealing wall 13 is configured like a deformable bag, for example made from rubber, and it has a (preferably single) opening connected to the mouth 9, for example through fusion, vulcanization, co-moulding, gluing or mechanically through crimping or screw clamping, so as to advantageously form a sealing wall 13-mouth 9 group that is prefabricated and able to be (preferably removably) connected to the rigid wall 4. As already stated earlier, the sealing wall 13-mouth 9 group may be removable and replaceable.

According to an alternative embodiment, structurally very simple and cost-effective but less versatile, the mouth 9 with the flexible sealing wall 13 are directly incorporated in the mandrel during the winding of the reinforcing layer 5 of the rigid wall 4 and are irreversibly connected to such a rigid wall 4.

According to a further aspect of the present invention, the tubular portion 15 of the rigid wall 4 comprises at least one first widened tubular section 21 and at least one second tubular section 22 that is adjacent to and narrower than the first widened tubular section 21.

Thanks to the widened tubular section 21 adjacent to the narrow tubular section 22 it is possible to receive clamps or locking brackets in the narrow tubular section 22 and exploit the areas adjacent to the locking brackets for the storage of the gas.

Thanks to the separation of the flexible sealing wall from the non-cylindrical rigid wall and to the possibility of sliding in pressing contact between them, the variations in diameters of the rigid wall cannot form areas of potential permeability of the sealing wall. In this way, it is possible to reconcile the contrasting requirements of seal and of walls of irregular shape.

Advantageously, the tubular portion 25 of the flexible sealing wall 13 does not present, in the state not inflated by the pressure of the gas, narrow tubular sections adjacent to widened tubular sections or, in other words, in the non-inflated state, the shape of the tubular portion 25 of the flexible sealing wall 13 does not follow the outline or the shape of the tubular portion 15 of the rigid wall 4.

This makes it possible to manufacture, stock and use few ranges of flexible sealing walls for a large number of variants of gas cylinders with rigid walls of different shapes.

Figure 3:
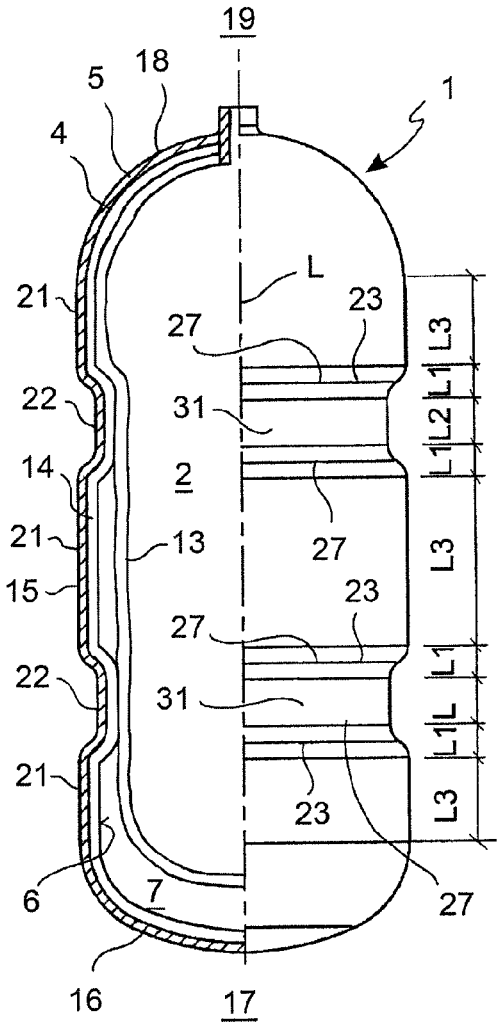
FIG. 3 is a partial longitudinal section view of a gas cylinder according to one further embodiment of the invention.

In accordance with a further aspect of the present invention (FIG. 3), the narrow sections 22 form a plurality of preferably two annular necks each of which is defined on both sides by respective widened tubular sections 21.

This particular configuration of the cylinder allows a correct positioning of the locking clamps and prevents them from accidentally sliding in the longitudinal direction L of the gas cylinder 1.

In order to best reconcile the requirements of stressing the tubular portion 15 as much as possible as a "tight membrane" and of it having a non-cylindrical shape such as to exploit to the maximum the available space for storing the gas, the narrow section 22 or, preferably, all of the narrow sections 22 respectively form a circular cylindrical central ring 31 having a constant diameter along the longitudinal axis L and two side transition rings 27 that connect the central ring 31 to the adjacent widened tubular sections 21, forming a circumferential step.

Figure 2:
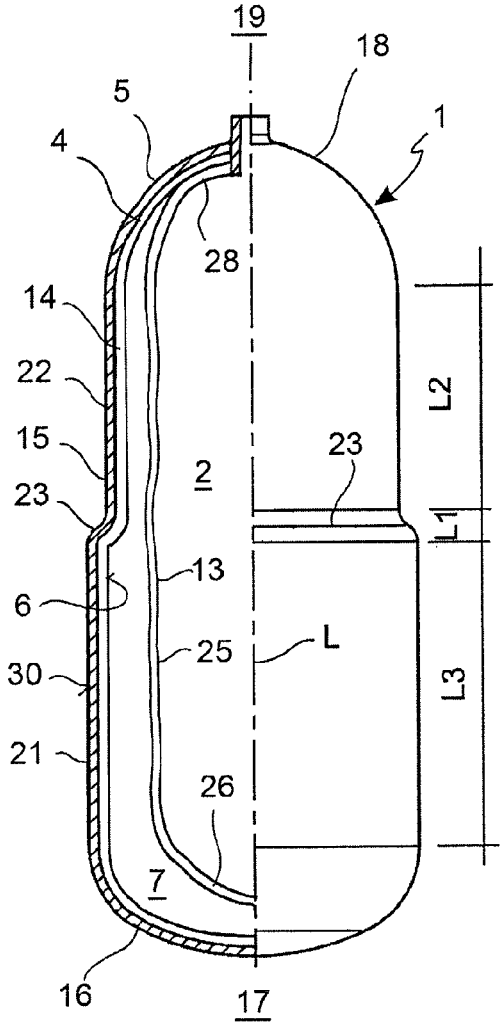
FIG. 2 is a partial longitudinal section view of a gas cylinder according to one further embodiment of the invention.
Figure 6:
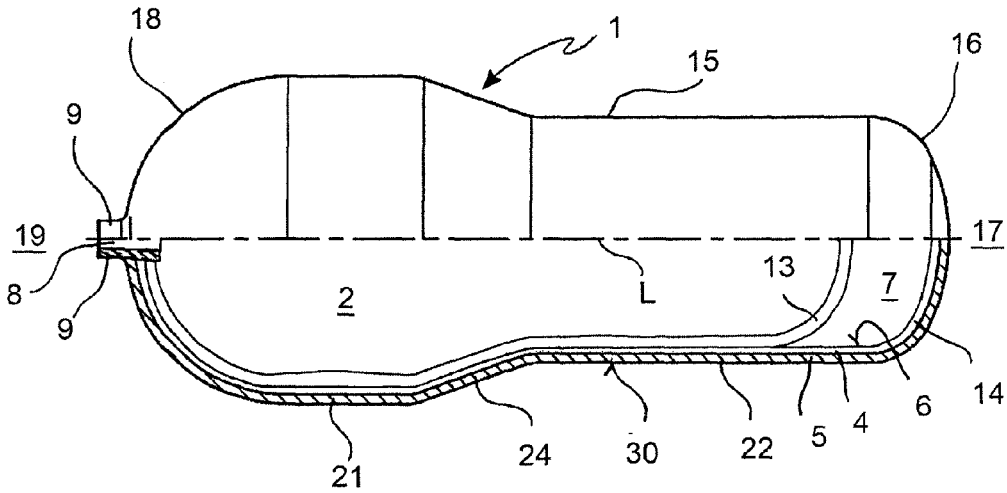
FIG. 6 is a partial longitudinal section view of a gas cylinder according to one further embodiment of the invention.

Advantageously, the side rings 27, in a longitudinal section plane that comprises the longitudinal axis L, have a shape with double curvature (FIG. 2) or frustum of cone 24 (FIG. 6) and a longitudinal extension L1 shorter than the longitudinal extension L2 of the cylindrical central ring 31. In order to reduce the flexional stresses of the narrowed areas it is advantageous to provide for the longitudinal extension L2 of the central ring to be shorter than the sum of the longitudinal extensions L1 of the side rings, i.e. $L2<2L1$.

The widened tubular sections 21 also preferably form one or more circular cylindrical rings with constant diameter along the longitudinal axis L of the cylinder 1.

In accordance with an embodiment (FIG. 2), the tubular portion 15 forms a single first widened section 21 and a single second narrow section 22 adjacent to the widened section 21 and separated from it by an internally bevelled circumferential step 23 or by an internally bevelled frusto-conical joint 24, formed from a single side ring 27 of the narrow section 22 that may be shaped as described earlier.

In this way, the gas cylinder 1 has an overall shape tapered with a step that allows it to be fixed through one or more locking brackets in the tapered area without leaving unused spaces in the cylinder space of the application, for example a gas-powered vehicle.

Figure 8:
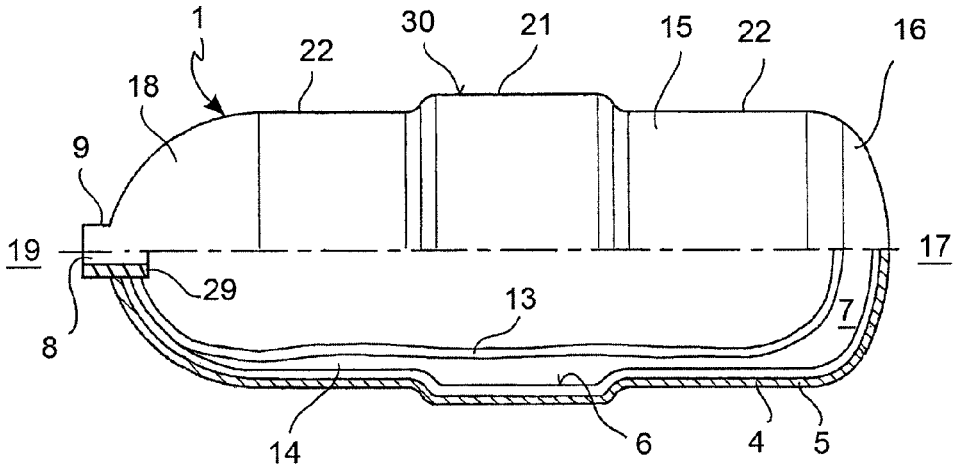
FIG. 8 is a partial longitudinal section view of a gas cylinder according to one further embodiment of the invention.

In accordance with a further aspect of the present invention (FIG. 8), two narrow sections 22 form respectively an upper section and a lower section of the tubular portion 15, between which a widened tubular section 21 extends forming an intermediate section, preferably substantially central, of such a tubular portion 15.

As visible from the figures, the thickness of the tubular portion 15 of the rigid wall 4 does not substantially vary, in other words the inner surface 6 of the rigid wall 4, in the area of the tubular portion 15, substantially follows the shape of its outer surface 30, so that the shaping of the tubular portion 15 to the external space conditions translate into a maximisation of the gas storage space 2 inside the cylinder 1.

According to a further aspect of the present invention (FIG. 8), advantageously able to be made in combination with single or all of the characteristics described up to here, the mouth 9 of the gas cylinder 1 comprises an internally threaded inner portion 29 projecting inside the gas storage space 2 defined by the flexible sealing wall 13.

Thanks to the configuration of the threaded mouth 9 that at least partially projects inside the gas storage space 2, it is possible to also exploit at least one part of the cylinder height, in any case necessary to screw in the stop valve, to store the gas.

Figure 4:
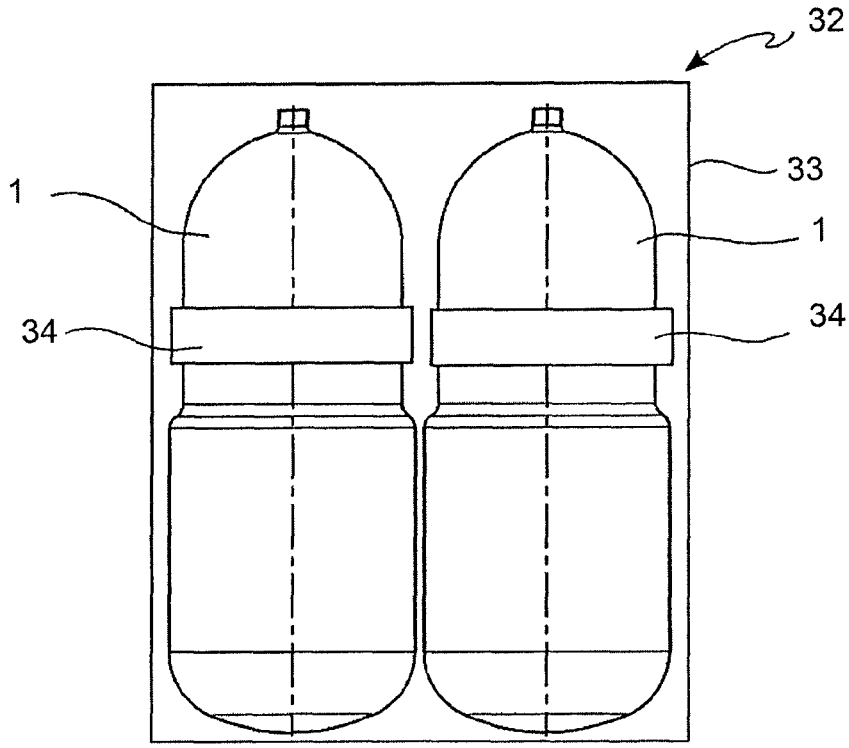
FIGS. 4 and 5 illustrate cylinder spaces with gas cylinders according to FIGS. 2 and 3.
Figure 5:
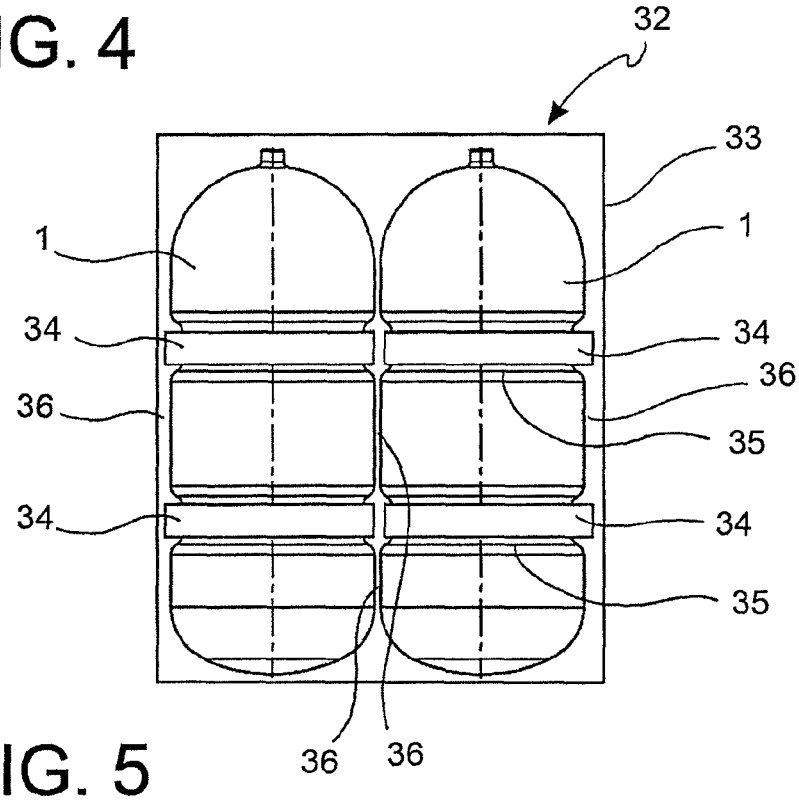

FIGS. 4 and 5 illustrate embodiments of cylinder space-cylinder groups 32 for gas applications, for example vehicles. The cylinder space-cylinder group 32 comprises one or more gas cylinders 1 according to what has been described previously, a support and containment structure 33 able to be fixed to or formed at a bearing structure of the application (for example of a vehicle) and configured to at least partially receive such gas cylinders, as well as one or more locking members 34, preferably clamps or locking brackets, anchored or able to be anchored to the support and containment structure 33 and suitable for at least partially wrapping around said gas cylinders 1 to lock them to the support and containment structure 33. Such locking members 34 have at least one portion received in a circumferential seat 35 formed from the narrow section 22 in the outer surface 30 of the gas cylinder 1. Moreover, at least one of the widened sections 21 of the tubular portion 15 of the rigid wall 4 extends in a gap 36 (otherwise unused), defined between two locking members 34 or between a locking member 34 and the support and containment structure 33.

Figure 7:
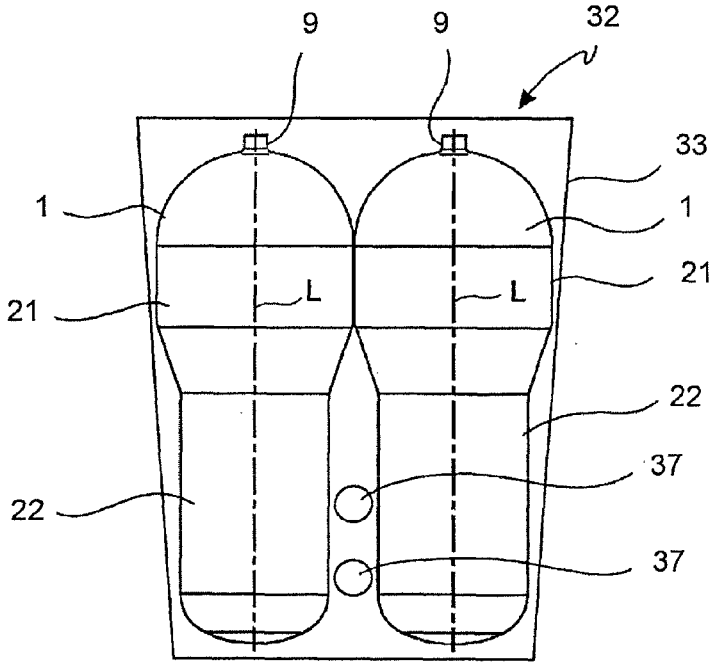
FIG. 7 illustrates a cylinder space with gas cylinder according to FIG. 6.

FIG. 7 illustrates a further cylinder space-cylinder group 32, in which the support and containment structure 33 comprises side walls inclined with respect to one another and/or interruptions due to functional elements 37 (for example reinforcing stays or tubes) and the cylinder(s) 1 adapt to the shape of the containment structure 33 thanks to the presence of the widened and narrow sections 21, 22.

Of course, a man skilled in the art may bring further modifications and variants to the gas cylinder made from composite material and to the cylinder space-gas cylinder group according to the present invention, in order to satisfy contingent and specific requirements, all of which are covered by the scope of protection of the invention, as defined by the following claims.

The invention claimed is:

1. Gas cylinder (1) internally defining a gas storage space (2) able to be closed by a stop valve (3), wherein said cylinder (1) comprises:

a rigid wall (4) made from composite material having a reinforcing layer (5) containing reinforcing fibres and an inner surface (6) that defines an inner space (7) accessible through an access opening (8) formed in the rigid wall (4), a tubular mouth (9) connected to the access opening (8) of the rigid wall (4) and configured to receive the stop valve (3) in communication with the gas storage space (2), a flexible sealing wall (13) arranged in the inner space (7) and connected to the rigid wall (4) only through the mouth (9), said flexible sealing wall (13) internally defining said gas storage space (2) and being suitable for adhering in pressing contact against the inner surface (6) of the rigid wall (4), wherein the rigid wall (4) is permeable to air so as to allow a complete expansion of the flexible wall (13) in the inner space (7) and the inner surface (6) is formed from a sliding layer (14) of the rigid wall (4) different from the reinforcing layer (5) and that allows sliding in pressing contact between the flexible sealing wall (13) and the rigid wall (4).

2. Gas cylinder (1) according to claim 1, wherein the mouth (9) comprises a cylinder connection portion (11) suitable for removably engaging a mouth connection seat (12) formed from the rigid wall (4) at the opening (8).

3. Gas cylinder (1) according to claim 1, wherein the mouth (9) comprises a cylinder connection portion (11) suitable for removably engaging a mouth connection seat (12) formed from a body (20) initially distinct and then connected with the rigid wall (4).

4. Gas cylinder (1) according to claim 1, wherein the reinforcing fibres of the reinforcing layer (5) have a tensile strength of over 4500 MPa and a modulus of elasticity of over 200 GPa and wherein said reinforcing layer (5) comprises a content of reinforcing fibres within the range from 50% vol to 70% vol, preferably from 55% vol to 65% vol, even more preferably about 60% vol.

5. Gas cylinder (1) according to claim 1, wherein said inner surface (6) is smooth and without edges or steps, with the exception of the edge of the access opening (8).

6. Gas cylinder (1) according to claim 1, wherein said sliding layer (14) comprises a thermoplastic synthetic material selected from the group comprising polyethylene, PET, polyester, polyvinylchloride, polytetrafluoroethylene.

7. Gas cylinder (1) according to claim 1, wherein said sliding layer (14) comprises a substance selected from the group consisting of:

lubricant powder containing nano-particles suitable for reducing the friction coefficient between the rigid wall (4) and the flexible sealing wall (13), lubricant fluid, lubricant grease, lubricant oils, lubricant gels.

8. Gas cylinder (1) according to claim 1, wherein the sliding layer (14) is fixed to the reinforcing layer (5) by means of moulding of the sliding layer (14) and subsequent winding of the reinforcing layer (5) around the sliding layer (14).

9. Gas cylinder (1) according to claim 1, wherein the sliding layer (14) is fixed to the reinforcing layer (5) by means of blow-moulding in a mould containing said reinforcing layer (5).

10. Gas cylinder (1) according to claim 1, wherein the sliding layer (14) is fixed to the reinforcing layer (5) by means of spraying.

11. Gas cylinder (1) according to claim 1, wherein the sliding layer (14) is fixed to the reinforcing layer (5) by means of dip coating.

12. Gas cylinder (1) according to claim 1, wherein the flexible sealing wall (13) forms a deformable bag with an opening connected to the mouth (9) so as to form a sealing wall (13)—mouth (9) group that is prefabricated and able to be reversibly connected to the rigid wall (4).

13. Gas cylinder (1) according to claim 1, wherein the flexible sealing wall (13) is connected to the mouth (9) through connection means selected from the group comprising:

vulcanized join, co-moulded join, gluing, mechanical join through crimping or screw clamping.

14. Gas cylinder (1) according to claim 1, wherein the mouth (9) with the flexible sealing wall (13) are irreversibly connected to such a rigid wall (4).

15. Gas cylinder (1) according to claim 1, wherein said sliding layer (14) comprises a fabric.

16. Gas cylinder (1) according to claim 1, wherein the rigid wall (4) comprises a tubular portion (15) with at least one widened first tubular section (21) and at least one second tubular section (22) adjacent to and narrower than the first tubular section (21).

17. Gas cylinder (1) according to claim 15, wherein said flexible sealing wall (13) has a shape that, in the deflated state, is incompatible with the shape of the tubular portion (15) of the rigid wall (4) and, in the inflated state, adapts to the shape of the rigid wall (4).

18. Cylinder space—gas cylinder group (32), comprising at least one gas cylinder (1) internally defining a gas storage space (2) able to be closed by a stop valve (3), wherein said gas cylinder (1) comprises:

a rigid wall (4) made from composite material having a reinforcing layer (5) containing reinforcing fibres and an inner surface (6) that defines an inner space (7) accessible through an access opening (8) formed in the rigid wall (4), a tubular mouth (9) connected to the access opening (8) of the rigid wall (4) and configured to receive the stop valve (3) in communication with the gas storage space (2), a flexible sealing wall (13) arranged in the inner space (7) and connected to the rigid wall (4) only through the mouth (9), said flexible sealing wall (13) internally defining said gas storage space (2) and being suitable for adhering in pressing contact against the inner surface (6) of the rigid wall (4), wherein the rigid wall (4) is permeable to air so as to allow a complete expansion of the flexible wall (13) in the inner space (7) and the inner surface (6) is formed from a sliding layer (14) of the rigid wall (4) different from the reinforcing layer (5) and that allows sliding in pressing contact between the flexible sealing wall (13) and the rigid wall (4), said cylinder space—gas cylinder group (32) further comprising:

a support and containment structure (33) able to be fixed to a bearing structure of an application and configured to at least partially receive said gas cylinders (1), one or more locking members (34) anchored to the support and containment structure (33) and suitable for at least partially wrapping around said gas cylinders (1) so as to lock them to the support and containment structure (33), wherein said locking members (34) are partially received in a circumferential seat (35) of the gas cylinder (1) formed by its narrow portion (22) and the widened portion (21) extends into a gap (36) defined by the locking member (34) and the support and containment structure (33).

* * * * *